US008587212B2

(12) United States Patent
Li et al.

(10) Patent No.: US 8,587,212 B2
(45) Date of Patent: Nov. 19, 2013

(54) LIGHTING SYSTEM, DIMMING CONTROL APPARATUS AND DIMMING CONTROL METHOD

(75) Inventors: Hung-Chun Li, Zhongli (TW); Wun-Long Yu, Yongjing Township, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 192 days.

(21) Appl. No.: 13/118,296

(22) Filed: May 27, 2011

(65) Prior Publication Data

US 2012/0038287 A1 Feb. 16, 2012

Related U.S. Application Data

(60) Provisional application No. 61/372,279, filed on Aug. 10, 2010.

(30) Foreign Application Priority Data

Dec. 10, 2010 (TW) ..... 99143317 A

(51) Int. Cl.
*H05B 41/16* (2006.01)
*H05B 37/00* (2006.01)

(52) U.S. Cl.
USPC ..... 315/250; 315/312; 315/294; 315/297

(58) Field of Classification Search
USPC ..... 315/294, 297, 315, DIG. 4, 299, 195, 315/307, 295, 316
See application file for complete search history.

(56) References Cited

U.S. PATENT DOCUMENTS

| | | | | |
|---|---|---|---|---|
| 5,128,594 | A * | 7/1992 | Watanabe et al. | 315/294 |
| 5,359,364 | A | 10/1994 | Kayanuma | |
| 6,158,882 | A | 12/2000 | Bischoff, Jr. | |
| 6,163,275 | A | 12/2000 | Hartzell | |
| 6,683,419 | B2 | 1/2004 | Kriparos | |
| 6,841,947 | B2 | 1/2005 | Berg-Johansen | |

(Continued)

FOREIGN PATENT DOCUMENTS

| | | |
|---|---|---|
| TW | M252234 | 12/2004 |
| TW | I231158 | 4/2005 |

(Continued)

OTHER PUBLICATIONS

Lekic et al., "A Multifunctional Microcontroller Device Which Can be Connected to RS232 Hub," Applied Electronics, 2006, Pilsen 6, Sep. 7, 2006.

(Continued)

*Primary Examiner* — Vibol Tan
(74) *Attorney, Agent, or Firm* — Muncy, Geissler, Olds & Lowe, PLLC

(57) ABSTRACT

A lighting system, a dimming control apparatus, and a dimming control method are provided. The dimming control apparatus includes a control unit and a dimming driving unit. In response to a dimming command and a number, the control unit decodes the dimming command into a plurality of sub-dimming commands. The dimming driving unit has a plurality of output terminals for coupling to a plurality of lamp modules. According to the sub-dimming commands, the control unit controls the dimming driving unit to output a plurality of dimming driving signals corresponding to the lamp modules to adjust the brightness of each lamp module individually.

15 Claims, 5 Drawing Sheets

(56) References Cited

U.S. PATENT DOCUMENTS

| | | | | |
|---|---|---|---|---|
| 6,955,444 | B2 | 10/2005 | Gupta | |
| 7,038,399 | B2 | 5/2006 | Lys | |
| 7,276,863 | B2 | 10/2007 | Lee | |
| 7,301,522 | B2 | 11/2007 | Ko | |
| 7,321,203 | B2 | 1/2008 | Marosek | |
| 7,352,138 | B2 | 4/2008 | Lys | |
| 7,362,221 | B2 | 4/2008 | Katz | |
| 7,368,977 | B2 * | 5/2008 | Wei et al. | 327/536 |
| 7,486,032 | B2 | 2/2009 | Lee | |
| 7,498,754 | B2 | 3/2009 | Masood | |
| 7,535,183 | B2 | 5/2009 | Gurr | |
| 7,642,734 | B2 | 1/2010 | De Anna | |
| 7,649,327 | B2 | 1/2010 | Peng | |
| 7,723,926 | B2 | 5/2010 | Mednik | |
| 7,903,082 | B2 | 3/2011 | Sakurai | |
| 7,948,468 | B2 * | 5/2011 | Zane et al. | 345/102 |
| 2005/0122060 | A1 | 6/2005 | Yu et al. | |

FOREIGN PATENT DOCUMENTS

| | | | |
|---|---|---|---|
| TW | M344700 | | 11/2008 |
| TW | I305999 | | 2/2009 |
| TW | 200911026 | A | 3/2009 |
| TW | I310292 | B | 5/2009 |
| TW | I316691 | | 11/2009 |
| TW | M368994 | | 11/2009 |
| TW | 201007667 | A | 2/2010 |
| TW | M381241 | | 5/2010 |

OTHER PUBLICATIONS

Kurdthongmee, "Design and implementation of an FPGA-based multiple-colour LED display board," Microprocessors and Microsystems, 29, 2005, pp. 327-336.

Doshi et al., "Digital Architecture for Driving Large LED Arrays with Dynamic Bus Voltage Regulation and Phase Shifted PWM," Proc. IEEE Appl. Power Electron. Conf. Expo., Anaheim, CA, Feb. 2007, pp. 287-293.

Yu et al., "High performance white LED driver with single-wire serial-pulse digital dimming," The Journal of China Universities of Posts and Telecommunication, Feb. 2009, 16(1), pp. 95-99.

Doshi et al., "Reconfigurable and fault tolerant phase shifted modulator for luminance control of LED light sources," Proc. IEEE Power Electron. Specialists Conf., Athens, Greece, Jun. 2008, pp. 4185-4191.

* cited by examiner

LIGHTING SYSTEM, DIMMING CONTROL APPARATUS AND DIMMING CONTROL METHOD

This application claims the benefit of U.S. provisional application Ser. No. 61/372,279, filed Aug. 10, 2010, and the benefit of Taiwan application Serial No. 99143317, filed Dec. 10, 2010, the subject matters of which are incorporated herein by reference.

BACKGROUND

1. Technical Field

The disclosure relates in general to a dimming control apparatus and a method thereof, and more particularly to a dimming control apparatus applicable to light emitting diode lamp modules and a method thereof.

2. Description of the Related Art

While energy saving issues are widely concerned around the world, one of the important parts is to find alternatives replacing the conventional illumination. Light emitting diode (LED) related technologies are now a focus of research and development since LEDs, as the alternative, have the advantages of energy efficiency and low power consumption. However, the development and popularity of LED technologies encounter bottlenecks and they should be broken through with respect to different aspects, rather than the design aspect only. One aspect is to satisfy the demands for dimming control and ambient lighting. The LED related technologies become significant technologies since the consumers realize that the LED not only provides the illumination but also contributes to power saving. To fulfill the needs for the consumers for practical applications, the design of dimming control and ambient lighting becomes crucial to the market of LED fixtures. Another aspect is to reduce the cost of LED fixtures. The dimmable LED fixture is composed of a dimming unit and an LED fixture. For indoor lighting applications that require dimming function to control each unit, the cost will be increased inevitably.

In order to meet the needs for digital dimming, the cost of the LED lighting system could be increased in view of limitation of the general lighting control system. The disadvantage of the general lighting control system, such as digital addressable lighting interface (DALI) or digital multiplex interface (DMX), is that the number of addressable units is limited. For example, the DALI lighting system can control up to 64 addressable units only. The modularized LED fixture design becomes a popular design and a modularized LED fixture is composed by a digital dimming system and several LED modules. For providing dimming control for individual LED module, an LED lighting system including a number of LED fixtures must employ a considerable number of digital dimming systems, resulting in a higher cost for deployment. Such a high cost would affect the popularity of the LED lighting system with individual dimming control. Therefore, it is desirable to reduce the cost so as to facilitate the wider use of the LED lighting systems.

SUMMARY

The disclosure is directed to a dimming control apparatus and a method thereof. By decoding a dimming command into a plurality of sub-dimming commands, addressable dimming control can be performed on different modularized lamp modules, individually. Therefore, the complexity in the implementation of the circuit of the dimming control apparatus can be simplified, and addressable dimming control can be performed on multiple LED modules individually. The cost of the lighting system deployment can be reduced so as to facilitate the wider use of the LED lighting systems.

According to a first aspect of the present disclosure, a dimming control apparatus is provided. The dimming control apparatus includes a control unit and a dimming driving unit. The control unit, in response to a dimming command and a number, decodes the dimming command into a plurality of sub-dimming commands. The dimming driving unit has a plurality of output terminals for coupling to a plurality of lamp modules. According to the sub-dimming commands, the control unit is used to control the dimming driving unit to output a plurality of dimming driving signals corresponding to the lamp modules. The brightness of each lamp modules can be individually adjusted by the dimming commands.

According to a second aspect of the present disclosure, a lighting system is provided. The lighting system includes a plurality of lamp modules, a dimming control apparatus, and a dimming command input unit. The dimming control apparatus includes a control unit and a plurality of dimming driving units. The lamp modules are respectively coupled to the dimming driving units of the dimming control apparatus. The dimming command input unit is coupled to the control unit of the dimming control apparatus to receive a dimming command. In addition, in an embodiment, the lighting system includes a number setting device to receive a number indicative of the number of lamp modules that may be employed.

According to a third aspect of the present disclosure, a dimming control method is provided for adjusting the brightness of a plurality of lamp modules. The method includes the following steps. In response to a dimming command and a number, a dimming command is divided into a plurality of sub-dimming correspond with the number. A plurality of dimming driving signals are generated according to sub-dimming commands to adjust the brightness of each lamp module individually.

The above and other aspects of the disclosure will become better understood with regard to the following detailed description of the non-limiting embodiment(s). The following description is made with reference to the accompanying drawings.

DETAILED DESCRIPTION

The followings embodiments are related to a dimming control apparatus and a method thereof. By decoding or dividing a dimming command into a plurality of sub-dimming commands, addressable dimming can be performed on different lamp modules individually. In the following embodiments, LED modules are used for exemplification.

However, the followings embodiments can be exemplified with other suitable lamp modules.

First Embodiment

Figure 1:
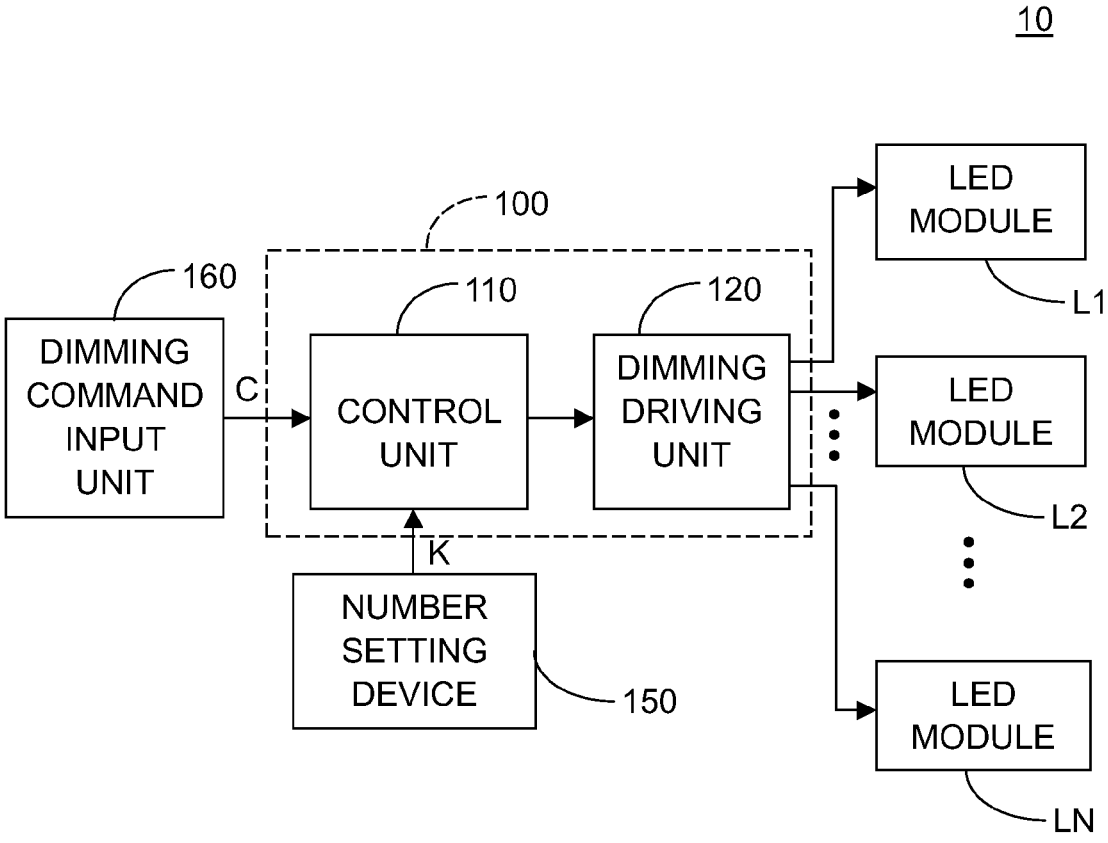
FIG. 1 shows a lighting system using a dimming control apparatus according to a first embodiment.

Referring to FIG. 1, it is a lighting system using a dimming control apparatus according to a first embodiment. As indicated in FIG. 1, the lighting system 10 includes a dimming control apparatus 100 and at least one of the LED modules L1 to LN, wherein N denotes the number of LED modules which are actually used with N≥1. In the present embodiment, a plurality of LED modules are used for exemplification, but the disclosure is not limited thereto. In response to a dimming command C and a number K, the dimming control apparatus 100 can generate K addressable sub-dimming commands corresponding to K LED modules to provide dimming control to the K LED modules individually, such as dimming control of either 0% or 100%, or dimming control with dimming levels from 0 to 100%, wherein the number K indicates the number of LED (lamp) modules that may be employed. The dimming control apparatus 100 outputs a plurality of dimming driving signals corresponding to K LED modules in response to the K addressable sub-dimming commands to control the brightness of the K LED modules individually. Each of the LED modules may include one or a plurality of LEDs, but the embodiment is not limited thereto. Suppose an LED module has a plurality of LEDs. In response to the dimming driving signal, the LEDs of the same LED module can output the same brightness level. In addition, the number K is larger than or equal to the number N of the LED modules, so that the dimming control apparatus 100 can individually control the LED modules L1 to LN. In the present embodiment, the number K is equal to the number N of the LED modules (i.e., the dimming control apparatus 100 can individually control the LED modules L1 to LN), but the embodiment is not limited thereto.

The dimming control apparatus 100 includes a control unit 110 and a dimming driving unit 120. The control unit 110 receives a dimming command C for controlling the dimming driving unit 120. The control unit 110 receives the dimming command C and obtains a number K, and further divides the dimming command C into K addressable sub-dimming commands corresponding to the number K. The dimming driving unit 120 has a plurality of output terminals for coupling to a plurality of LED modules L1 to LN. The control unit 110 controls the dimming driving unit 120 according to the sub-dimming commands, and enables the dimming driving unit 120 to output K dimming driving signals to control the K LED modules individually. In other words, the dimming driving signal of each LED module is for individually adjusting the brightness of the corresponding LED module coupled to one of the output terminals of the dimming driving unit 120. In this way, the dimming control apparatus 100 can achieve addressable dimming.

The dimming command C has M bits (M≥2). For example, a dimming command C can be an 8-bit command. When K equals 8, this indicates that the dimming control apparatus 100 can drive 8 LED modules L1 to L8, and the 8 bits of the dimming command C can be denoted as $C=B_7B_6B_5B_4B_3B_2B_1B_0$. The control unit 110 decodes or divides the dimming command C into 8 sub-dimming commands, which respectively are denoted by $B_0$, $B_1$, $B_2$, $B_3$, $B_4$, $B_5$, $B_6$, $B_7$ and correspond to 8 LED modules L1 to L8 respectively. The dimming driving unit 120 outputs the dimming driving signals corresponding to the 8 LED modules according to the foregoing 8 sub-dimming commands to individually drive the 8 LED modules. In the present example, each LED module is controlled by 1 bit (for example, the LED module L3 is controlled by $B_2$), so the dimming level is either 0 or 100%, i.e., either turned on or turned off. When K equals 2, this indicates that the dimming control apparatus 100 can drive two LED modules L1 and L2. Meanwhile, the control unit 110 divides the 8 bits of the dimming command C into two sub-dimming commands, which are denoted by $B_3B_2B_1B_0$ and $B_7B_6B_5B_4$ and correspond to two LED modules L1 to L2 respectively. According to the two sub-dimming commands, the dimming driving unit 120 outputs the dimming driving signals corresponding to the two LED modules to individually drive the two LED modules. In the present example, each LED module is controlled by 4 bits (for example, the LED module L2 is controlled by $B_7B_6B_5B_4$), and the brightness of the LED module between 0 to 100% can be controlled with $2^4$ (i.e., 16) dimming levels. The control unit 110 decodes or divides the M bits of the dimming command C into a plurality of sub-dimming commands corresponding to the number K, wherein each of the sub-dimming commands has at least one bit. In other words, the number of bits of the corresponding sub-dimming command determines the number of dimming levels of the brightness between 0 to 100% to which every LED module can be set.

In addition, the number K does not indicate the actual number N of LED modules. When K equals 8, the actual number N of LED modules coupled to the dimming driving unit 120 may be at least one to 8, wherein each LED module is controlled by 1 bit. However, the present disclosure is not limited to the above exemplification.

In addition, the dimming control apparatus 100 and the dimming signal C can be designed for other number of bits such as 10 bits, 16 bits or other number of bits, and the numbers of addressable sub-dimming commands and the number of dimming levels can be changed according to actual needs.

As disclosed above, the complexity level and number of circuits required for dimming control can be reduced by decoding or dividing a dimming signal command C into a plurality of addressable sub-dimming commands to individually drive multiple LED modules, hence largely saving the cost for deployment of the LED lighting control system.

In addition, the embodiments allow for flexibility in implementation of the lighting system. For example, the input of the dimming command C and the number K can have different implementations according to the needs of practical applications. As indicated in FIG. 1, a number setting device 150 can be designed by using an analog, a digital or a mechanical switch or other circuit to receive the number K. In addition, the lighting system 10 can be designed to obtain the dimming command C with a dimming command input unit 160 realized by such as a remote controller or a control panel. The dimming command C and the number K can be inputted by the dimming command input unit 160 and the number setting device 150, which are respectively coupled to the control unit 110 of the dimming control apparatus 100. Moreover, the number setting device 150 and the dimming command input unit 160 can be realized by an integrated input device. In an example, to provide greater convenience and systematic management, the dimming command input unit 160 can be realized by a computing device such as computer, handheld device, mobile phone, and transmits the dimming command C to the dimming control apparatus 100 with serial or parallel communication. Programmable control or scheduling can be further achieved in this example. In another embodiment, the dimming control apparatus 100 can be realized to include a wired or wireless communication interface or communication module (such as RS-232, USB, Bluetooth or Wi-Fi) or via a network, for achieving local or remote control.

Other implementations of the dimming control apparatus 100 are further exemplified below.

Second Embodiment

Figure 2:
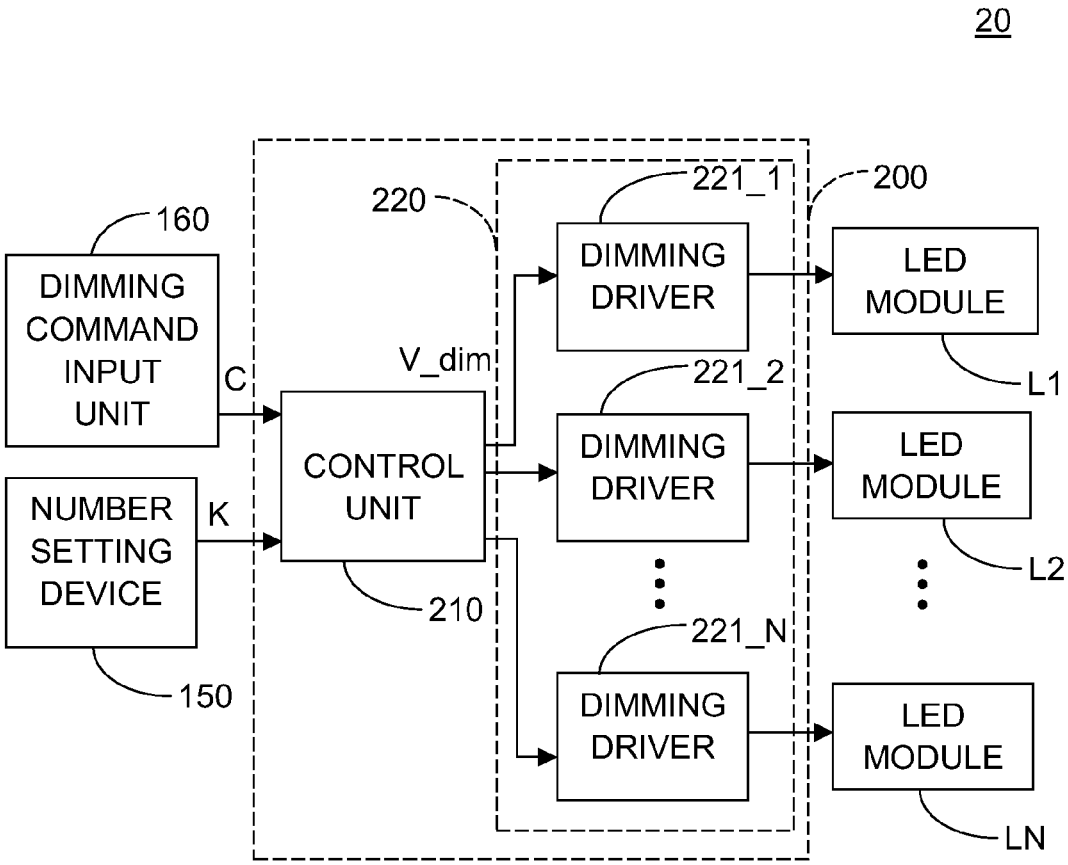
FIG. 2 shows a lighting system using a dimming control apparatus according to a second embodiment.

FIG. 2 shows a lighting system using a dimming control apparatus according to a second embodiment. In FIG. 2, the dimming control apparatus 200 of the lighting system 20 includes a control unit 210 and a dimming driving unit 220, wherein the dimming driving unit 220 further includes at least one of the dimming drivers 221_1 to 221_N with N≥1. In the present embodiment, a plurality of dimming drivers are used for exemplification, but the disclosure is not limited thereto. Each of the dimming drivers 221_1 to 221_N has an output terminal coupled to one of the LED modules L1 to LN in one-to-one manner. Since the LED modules L1 to LN may support different driving methods, each of the dimming drivers 221_1 to 221_N, according to the needs in practical application, can be implemented by digital dimming control (i.e., using PWM dimming) or analog dimming control such as a direct current voltage control circuit, or a circuit integrated with both the digital and analog approaches. The control unit 210 is a controller realized by such as a microcontroller. Like the operation of the dimming control apparatus 100 of the first embodiment, the control unit 210 decodes or divides the dimming command C into K sub-dimming commands to generate a plurality of dimming control signals V_dim, and respectively output the dimming control signals V_dim to the corresponding dimming drivers 221_1 to 221_N. Each of the dimming drivers 221_1 to 221_N generates a dimming driving signal (such as the PWM signals or the DC voltage signals) corresponding to the received dimming control signals V_dim to individually control the brightness of the LED modules L1 to LN coupled to the dimming drivers 221_1 to 221_N.

Third Embodiment

Figure 3:
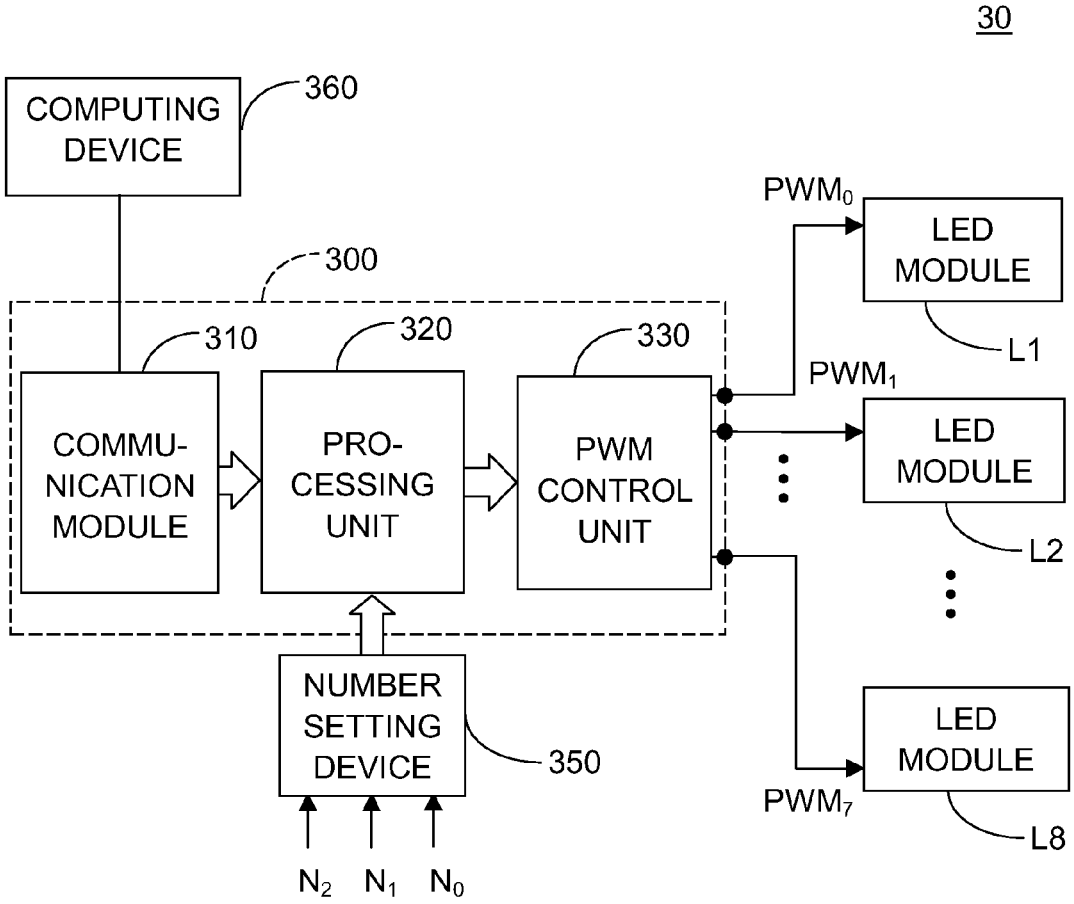
FIG. 3 shows a lighting system using a dimming control apparatus according to a third embodiment.

The control unit of the dimming control apparatus can be realized by a processing unit, e.g., a central processing unit (CPU). The dimming driving unit can be realized by a pulse width modulation (PWM) control unit. The dimming driving signals outputted from the PWM control unit are PWM signals. FIG. 3 shows a lighting system using a dimming control apparatus according to a third embodiment. In FIG. 3, the dimming control apparatus 300 of the lighting system 30 includes a communication module 310, a processing unit 320 and a PWM control unit 330. The dimming control apparatus 300 can be realized by internal circuitry of a microcontroller, such as a single-chip microcontroller, e.g., 8051 or the like. In this embodiment, the communication module 310 can be realized by such as an RS-232 or other serial or parallel communication interface for receiving the dimming command C. After the processing unit 320 obtains a dimming command C via the communication module 310, the dimming control apparatus 300 decodes or divides the dimming command C into a plurality of sub-dimming commands in a manner similar to the operation of the dimming control apparatus 100 of FIG. 1. The processing unit 320 controls the PWM control unit 330 according to the sub-dimming commands to output a plurality of addressable PWM signals to perform dimming control on a plurality of LED modules individually. In addition, the number setting device 350 can be realized by such as a setting switch or other circuitry, and the dimming command input unit can be realized by a computing device 360. For the sake of illustration, the number setting device 350 is exemplified by a DIP (dual in-line) switch for setting the number K, and outputting the number K to the processing unit 320 of the dimming control apparatus 300. The computing device 360 can be realized by a computer which outputs the dimming command C to the communication module 310 of the dimming control apparatus 300. The implementation is not limited thereto.

Figure 4A:
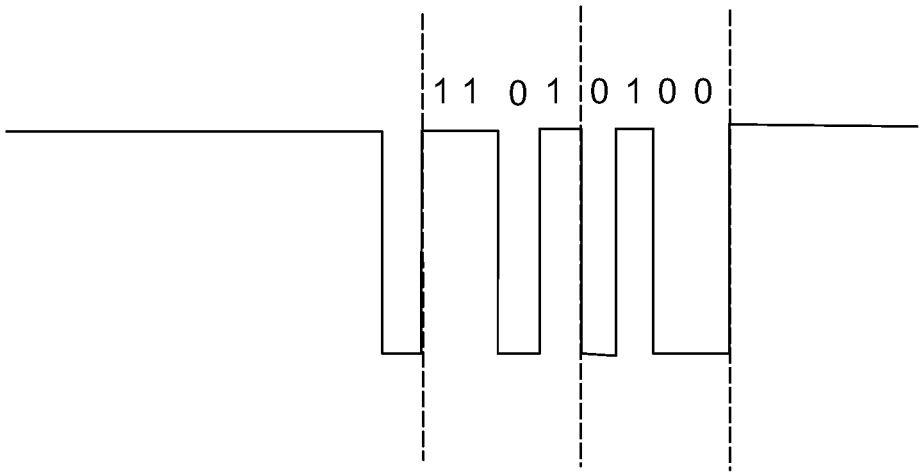
FIG. 4A shows an example of a dimming command.
Figure 4B:
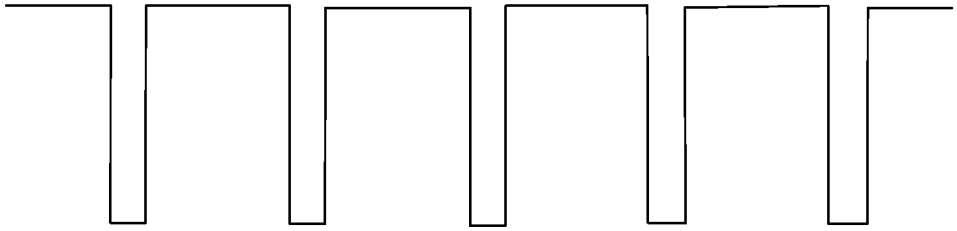
FIGS. 4B and 4C are examples of PWM driving signals corresponding to two sub-dimming commands obtained by dividing a dimming command.
Figure 4C:
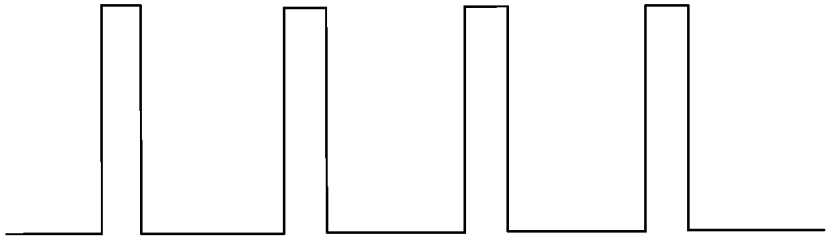

In the elaboration below, the number K is exemplified by 2. By using the number setting device 350, the number K can be obtained and expressed in binary expression as: $N_2N_1N_0$=001, and the dimming control apparatus 300 thus outputs two dimming driving signals. As indicated in FIG. 4A, the computing device 360 (such as a PC) can output a serial signal (i.e., the dimming command C): 11010100 via the communication module 310 (such as an RS-232 communication module). The processing unit 320 of the dimming control apparatus 300 automatically makes judgment according to the number $N_2N_1N_0$=001 obtained from the number setting device 350 to decode or divide the 8-bit serial signal (i.e., the dimming command C) into two PWM signals as dimming driving signals. Meanwhile, the two dimming driving signals $PWM_0$ and $PWM_1$ outputted by the dimming control apparatus 300 correspond to two groups of 4 bit data individually, thus 16 dimming levels can be achieved for each LED module. The duty cycles of the dimming driving signals are as follows. The duty cycle of the dimming driving signals $PWM_1$ corresponding to the higher bits $B_7B_6B_5B_4$=1101 is 81.25%, and the duty cycle of the dimming driving signals $PWM_0$ corresponding to the lower bits $B_3B_2B_1B_0$=0100 is 25%, and their outputs are indicated in FIG. 4B and FIG. 4C, respectively.

Table 1, obtained from the results of the foregoing embodiment, shows the relationships between the number of dimming levels, the dimming driving signals and the bits corresponding to duty cycle when the number K is set as 1, 2, 4 or 8.

TABLE 1

| Number K | Binary number $N_2N_1N_0$ | Number of dimming levels | Dimming driving signal and bits corresponding to duty cycle % |
|---|---|---|---|
| 1 | 000 | 256 | $PWM_0$: $B_7B_6B_5B_4B_3B_2B_1B_0$ |
| 2 | 001 | 16 | $PWM_1$: $B_7B_6B_5B_4$<br>$PWM_0$: $B_3B_2B_1B_0$ |
| 4 | 010 | 4 | $PWM_3$: $B_7B_6$; $PWM_2$: $B_5B_4$,<br>$PWM_1$: $B_3B_2$; $PWM_0$: $B_1B_0$ |
| 8 | 100 | 2 | $PWM_7$ to $PWM_0$: $B_7$ to $B_0$ |

Fourth Embodiment

Figure 5:
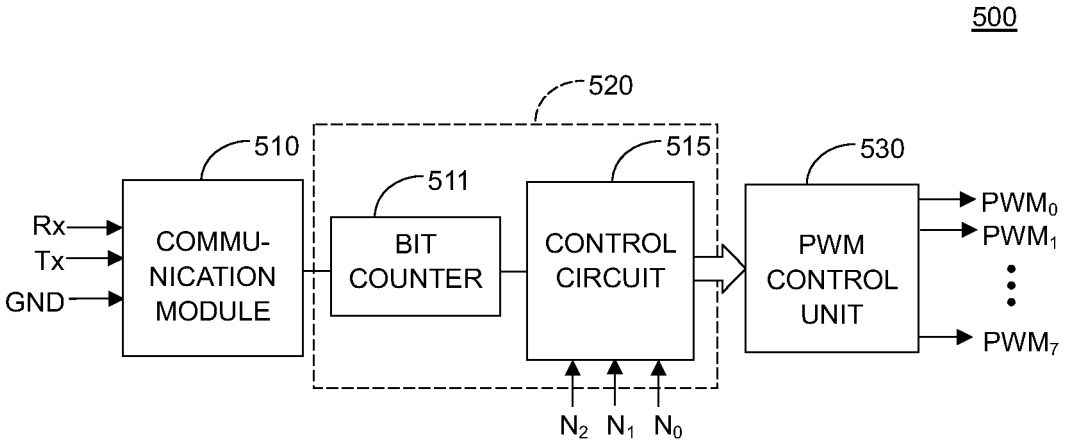
FIG. 5 shows a lighting system using a dimming control apparatus according to a fourth embodiment.

FIG. 5 shows a lighting system using a dimming control apparatus according to a fourth embodiment. The dimming control apparatus 500 of FIG. 5 differs from the dimming control apparatus 300 of FIG. 3 mainly in that the processing unit 320 is replaced by using other circuitry as a control unit 520. In this way, the control unit 520 can be realized by logic circuits for performing functions similar to those performed by the processing unit 320. For example, the control unit 520 includes a bit counter 511 and a control circuit 515. In practical application, the dimming control apparatus 500 can be implemented by a single chip instead of a microcontroller, so as to reduce the number of elements and simplify the manner of implementation, e.g., without programming. The control circuit 515 can be realized by logic circuitry such as multiplexer, de-multiplexer, register, or other logic circuits. In other examples, the communication module 510 can be realized by other communication module which performs communication via such as universal serial bus (USB), ultra-red light, and wireless network.

The operation of the dimming control apparatus 500 is exemplified below. According to the number K, the control circuit 515 detects the binary input signal $N_2N_1N_0$ corresponding to the number. Meanwhile, the value of $N_2N_1N_0$ is set, e.g., by a user, to determine the number of LED modules which may be controlled by the dimming control apparatus 500. The control circuit 515 determines how to process the dimming command C received from the bit counter 511 according to the value of the number K. Next, the control circuit 515 enables or disables the PWM control unit 530. The control circuit 515 activates the communication module 510. The bit counter 511 receives an M-bit dimming command C via the communication module 510, and further transmits the dimming command C to the control circuit 515. Then, according to the dimming command C, the control circuit 515 outputs dimming control signals corresponding to the number K to the PWM control unit 530, and the PWM control unit 530 further outputs a plurality of PWM signals (i.e., dimming driving signals). The communication module 510, the bit counter 511, and the control circuit 515 can also reset the PWM control unit 530 in response to a new dimming command C so as to update the brightness of individual LED module at any time.

In the foregoing embodiments, an 8-bit dimming command C is decoded or divided into a plurality of sub-dimming commands of the same number of bits for the sake of illustration. However, the implementation of the disclosure is not limited to 8-bit dimming command C, and the dimming command C can also be have 10 bits, 16 bits or other bits. In other examples, an 8-bit dimming command C can further be divided into 3, 5, 6 or 7 sub-dimming commands having different numbers of bits. For example, provided that the number K equals 3, the 8 bits of the dimming command C can be divided into $B_2B_1B_0$, $B_5B_4B_3$, $B_7B_6$. As a result, 3 dimming driving signals $PWM_O$, $PWM_1$, and $PWM_2$ are correspondingly outputted to provide 8, 8, and 4 dimming levels for controlling the brightness of 3 lamp modules respectively. Likewise, the operation can also be obtained in the same manner when the number K equals 5, 6 or 7. In other examples, the number of bits for the sub-dimming commands can be decoded or divided according to actual requirements. For example, the 8 bits of the dimming command C can be divided into $B_1B_0$, $B_5$, $B_4B_3B_2$, $B_7$, $B_6$. The three lamp modules for offering the ON/OFF control can be coupled to the output terminals corresponding to the sub-dimming commands $B_5$, $B_7$, $B_6$; and the two lamps modules for providing more dimming levels can be coupled to the output terminals corresponding to the sub-dimming commands $B_1B_0$, $B_4B_3B_2$. In this way, the hardware resource of the dimming control apparatus of each foregoing embodiment can be fully utilized and greater flexibility in dimming control can be allowed.

In the foregoing embodiments, the number input device 150 or 350 is exemplified by way of hardware, i.e. circuitry or switches. In other embodiments, the number K can be obtained and set by software or a default value of the dimming control apparatus of the lighting system, or by using the dimming control apparatus to detect the LED modules actually coupled to the output terminals of the dimming control apparatus. In further embodiments, the number K can be obtained by way of the dimming command input device, as exemplified above. In this manner, a number input device is an optional device or may be omitted in implementation.

The circuit in the foregoing embodiment can be realized by a dedicated chip such as application specific integrated circuit (ASIC). In addition, various lighting control systems or lamp dimming control modules can be based on the foregoing embodiment.

As disclosed in above embodiments, a dimming signal C is divided into a plurality of addressable dimming control signals to individually drive a plurality of LED modules, so that the circuit complexity and number of circuits required for dimming control are greatly reduced, hence largely saving the cost for deployment of the LED lighting control system. In addition, the foregoing embodiments allow for greater flexibility in implementation and application, and can extend to many different applications, such as local or remote, wired or wireless dimming control. By transmitting the dimming command C to the dimming control apparatus via a computing device, the brightness of the lamp can be controlled, scheduled, or monitored by way of programming.

While the disclosure has been described by way of examples and in terms of the exemplary embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dimming control apparatus, comprising:

a control unit, in response to a dimming command and a number, for decoding the dimming command into a plurality of sub-dimming commands, wherein the number is a positive integer; and a dimming driving unit having a plurality of output terminals for coupling to a plurality of lamp modules;

wherein according to the sub-dimming commands, the control unit controls the dimming driving unit to output a plurality of dimming driving signals corresponding to the lamp modules so as to control the brightness of each of the lamp modules individually, wherein the dimming command has a plurality of bits, the control unit divides the bits of the dimming command into the sub-dimming commands, according to the number, so that each of the sub-dimming commands has at least one bit.

2. The dimming control apparatus according to claim 1, wherein the dimming driving unit comprises:

a plurality of dimming drivers, each of which has an output terminal for coupling to the lamp modules in one-to-one manner.

3. The dimming control apparatus according to claim 2, wherein the control unit respectively outputs a plurality of dimming control signals to corresponding dimming drivers according to the sub-dimming commands.

4. The dimming control apparatus according to claim 3, wherein each of the dimming drivers generates the dimming driving signal according to the received dimming control signal to control the brightness of the lamp module coupled to the dimming driver.

5. The dimming control apparatus according to claim 1, wherein the dimming driving unit is a pulse-width modulation (PWM) control unit, and the dimming driving signals outputted by the dimming driving unit are PWM signals.

6. A lighting system, comprising:

a plurality of lamp modules;

a dimming control apparatus, comprising:

a control unit, in response to a dimming command and a number, for decoding the dimming command into a plurality of sub-dimming commands, wherein the number is a positive integer; and a dimming driving unit having a plurality of output terminals for coupling to the lamp modules respectively, wherein the control unit controls the dimming driving unit according to the sub-dimming commands, and enables the dimming driving unit to output a plurality of dimming driving signals corresponding to the lamp modules so as to control the brightness of each of the lamp modules individually; and a dimming command input unit, coupled to the control unit of the dimming control apparatus, for obtaining the dimming command, wherein the dimming command has a plurality of bits, the control unit divides the bits of the dimming command into the sub-dimming commands, according to the number, so that each of the sub-dimming commands has at least one bit.

7. The lighting system according to claim 6, wherein the dimming driving unit comprises:

a plurality of dimming drivers, each of which has an output terminal for coupling to the lamp modules in one-to-one manner.

8. The lighting system according to claim 7, wherein the control unit respectively outputs a plurality of dimming control signals to corresponding dimming drivers according to the sub-dimming commands.

9. The lighting system according to claim 8, wherein each of the dimming drivers generates the dimming driving signal according to the received dimming control signal to control the brightness of the lamp module coupled to the dimming driver.

10. The lighting system according to claim 6, wherein the dimming driving unit is a pulse-width modulation (PWM) control unit, and the dimming driving signals outputted by the dimming driving unit are PWM signals.

11. The lighting system according to claim 6, further comprising a number setting device, coupled to the control unit of the dimming control apparatus, for obtaining the number.

12. A dimming control method for adjusting brightness of a plurality of lamp modules, the method comprising:

(a) in response to a dimming command and a number, decoding the dimming command into a plurality of sub-dimming commands, wherein the number is a positive integer; and (b) generating a plurality of dimming driving signals according to the sub-dimming commands to adjust the brightness of the lamp modules individually, wherein the dimming command has a plurality of bits, and in the step (a), the bits of the dimming command are divided into the sub-dimming commands, according to the number, so that each of the sub-dimming commands has at least one bit.

13. The dimming control method according to claim 12, wherein the number of bits of one of the sub-dimming commands determines the number of dimming levels of the brightness between 0 to 100% for the corresponding lamp module.

14. The dimming control method according to claim 12, wherein the step (b) further comprises: generating a plurality of dimming control signals according to the sub-dimming commands.

15. The dimming control method according to claim 14, wherein the step (b) further comprises: generating the corresponding dimming driving signals according to the dimming control signals.

* * * * *